United States Patent [19]

Szabo et al.

[11] 4,171,716

[45] Oct. 23, 1979

[54] MEANS FOR DISPOSING SPENT CHEMICAL SOLUTIONS FROM PROCESSOR

[75] Inventors: Francis S. Szabo, Mountain Lakes; Helgard M. Kirsch, Irvington, both of N.J.

[73] Assignee: AM International, Inc., Los Angeles, Calif.

[21] Appl. No.: 890,053

[22] Filed: Mar. 27, 1978

[51] Int. Cl.[2] ..... B65B 1/04

[52] U.S. Cl. ..... 141/364; 141/115; 137/386; 354/324

[58] Field of Search ..... 354/297, 324, 326, 331, 354/333, 336, 337; 134/93, 100, 101; 141/115, 234, 363–366; 222/437, 457; 137/386, 453, 577, 577.5, 579, 590

[56] References Cited

U.S. PATENT DOCUMENTS

| | | | |
|---|---|---|---|
| 1,825,126 | 9/1931 | Powers | 354/336 |
| 2,578,000 | 12/1951 | Cronk | 137/577 |
| 3,137,225 | 6/1964 | Cuthbert | 354/324 |
| 3,173,577 | 3/1965 | Robbins et al. | 222/457 |
| 3,858,229 | 12/1974 | Stievenart | 354/324 |
| 4,012,753 | 3/1977 | Schmidt | 354/324 |

*Primary Examiner*—L. T. Hix
*Assistant Examiner*—Alan Mathews
*Attorney, Agent, or Firm*—Robert S. Hulse; Ray S. Pyle

[57] ABSTRACT

The disclosure is a two-solution tray, each a substantial duplicate of the other, and each illustrating the principle of a chicken feeder supply, an overflow control that doubles as a drain cock and a sealed system drain container for ecologically safe disposal of spent chemicals.

2 Claims, 3 Drawing Figures

MEANS FOR DISPOSING SPENT CHEMICAL SOLUTIONS FROM PROCESSOR

BACKGROUND OF THE INVENTION

Chemical film and print processors are known devices, and they are provided in a multitude of sizes and configurations. This invention is directed toward the table-top, two-part processor for passing a web through a developer solution and then a fixing or stop solution.

The chemicals used in such process are corrosive. They are known to clog and destroy valve cocks and drains. The strength of the chemicals in the fast processing of phototype setting materials is especially hazardous to the waste disposal system of offices and commercial printing establishments, as well as being ecologically abusive.

SUMMARY OF THE INVENTION

The principal accomplishment of this invention is to provide safe handling of hazardous film processing chemicals.

It is an object of the invention to provide ecologically safe disposal means for chemicals not suitable for sewer drain line disposal. Also, it is an object of this invention to provide a means for operator servicing of the chemicals with no danger to hands or clothing.

DESCRIPTION OF THE PREFERRED EMBODIMENT

Figure 1:
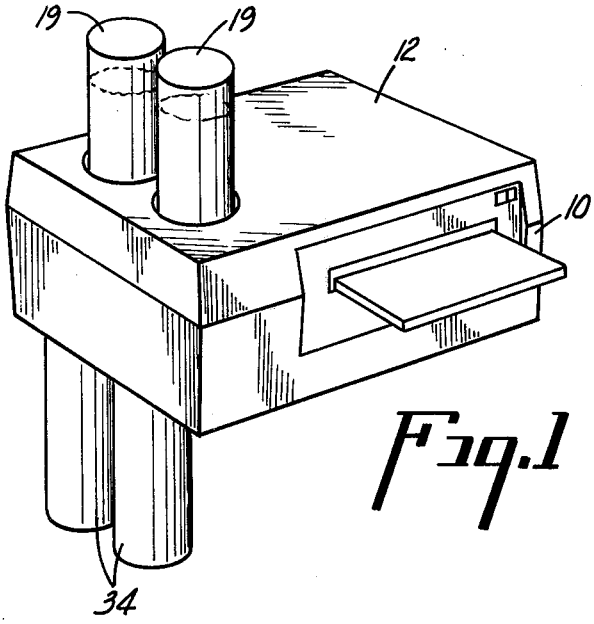
FIG. 1 is a perspective view of a dual tray assembly for processing and fixing photocomposition paper.

The drawings are essentially those of a commercial embodiment of the invention. The operating structure is located within a two-part enclosure consisting of a base housing 10 and a cap 12.

Supported within the housing is a tray 14. The tray 14 is a two-part tray in the illustrated commercial embodiment, but there is no limit to the number of individual sections that can be provided in a processing machine by the expedience of division walls between sections of the tray. Hereafter, the description will be of one such section with the understanding that each section is essentially similar.

A drive roller system 16 is conventional in nature and consists of drive rolls to cause a film web to proceed through the tray into and out of the solution and to squeeze excess chemicals from the surface of the web as it is processed. One set of the drive roller system will direct a web into the next in plural tray system.

The cap 12 has porthole openings 18 to accept the upper portion of a supply bottle 19. A molded screw threaded retainer 20 is positioned to accept the neck of supply bottle and be thus supported in an inverted position for maintaining a predetermined liquid level in the tray. The "chicken feeder" principal of the liquid supply is well known. The level of fluid will drop as processing uses and carries away some of the material, and fresh material will be added as the liquid level drops below the rim of the inverted container to allow air to enter the container. Otherwise, atmospheric pressure retains the supply within the bottle 19.

Figure 3:
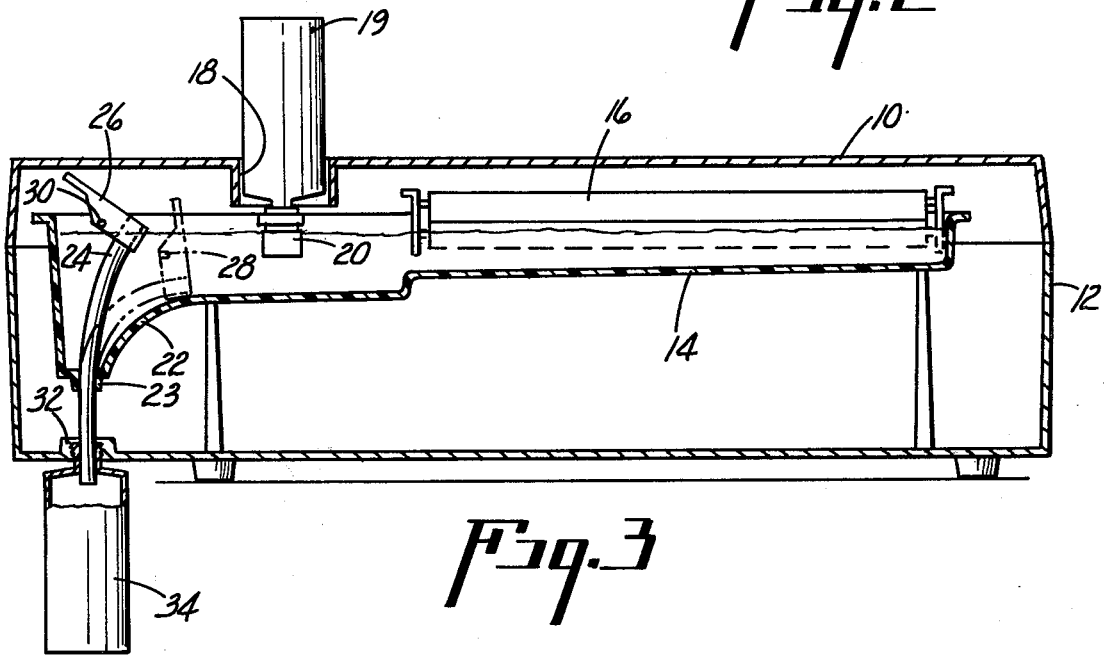
FIG. 3 is a longitudinal section through the processor revealing the configuration of the supply and drainage sumps, the overflow and drainage positions of the drain tube, and the position of the processing rollers.

The tray 14 is preferably, although not necessarily, formed in a sump configuration as shown in FIG. 3. A flexible drain tube 24 extends through the wall of the tray, and in the illustrated embodiment the particular wall is the bottom opening of the sump which is closed by a seal 23.

A flexible drain tube passes through the seal 23 in fluid tight relationship.

The tube 24 is provided with a handle 26 which enables the operator to swing the flexible drain tube from a natural and retained upright position as shown in full lines in FIG. 3 to a deflected position lying against the bottom of the sump as shown in dotted outline. When in the upright position, the tube will serve as an overflow drain to prevent accidental spillage of the chemical into the bottom of the housing 10 or onto the floor of the room. In the depressed condition, the tube serves the second purpose of a full drainage outlet.

Figure 2:
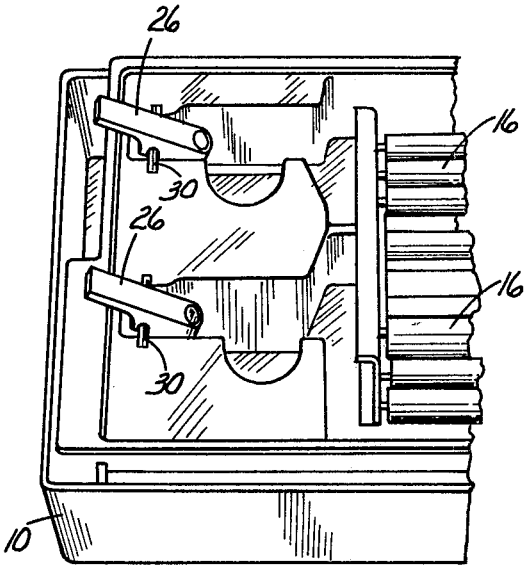
FIG. 2 is a perspective view of the filling and draining end of the processor, with the cap and supply bottles of FIG. 1 removed.

A notch 28 on the lower surface of the handle and a wire bail 30 permanently bridging the side walls of the sump area enable the handle to be secured by engaging the notch over the bail as illustrated in FIGS. 2 and 3.

Whenever it is desired to drain the spent chemicals and start with fresh chemicals, the operator merely tilts the finger grip portion of the handle 26 forward to disengage the notch from the retainer wire bail 30 and force the tube to flex into the phantom position illustrated. This is done without danger of contaminating the hands of the operator with the solution because the handle always projects above solution level.

Directly below the seal 23 is a molded screw threaded retainer 32 in the bottom of housing 10. This enables an empty bottle 34 to be secured over the end of the tube, or it may be considered that the tube extends into the area where it will be extended into the drain bottle engaged in the molded screw threaded retainer means 32. Generally, it will be expedient to save and use the empty supply bottle 19 for the purpose of the drainage bottle 34. Then, the bottle 34 may be disengaged from the retainer 32, capped and taken to a safe disposal area where it may be processed or otherwise safely disposed.

What is claimed is:

1. In an apparatus for chemically processing a web, said apparatus having a tray for holding a pool of liquid and means for holding a supply bottle inverted in position for maintaining a predetermined liquid level in the tray, the improvement in a chemical supply and disposal system, comprising:

a flexible drain tube extending through a selected bottom portion of said tray;

means for removably securing a drain container in an upright position below said tray;

said tube extending a selected distance upwardly into said tray and thereby serving as a depth limiting overflow drain, and being capable of being deflected to lie against the tray bottom for draining the fluid from said tray into said container;

whereby the means for holding a supply bottle and the means for securing a drain container are similarly configured, permitting emptied supply bottles to be used as drain containers, and whereby the spent chemical fluid is captured into the container for acceptable disposal.

2. The apparatus of claim 1 wherein the means for holding and the means for securing are similarly configured by being similarly threaded, the supply bottle and drain container being cappable by threaded caps.

* * * * *